US011164688B2

(12) United States Patent
Iguchi et al.

(10) Patent No.: US 11,164,688 B2
(45) Date of Patent: Nov. 2, 2021

(54) CHIP RESISTOR

(71) Applicant: KOA CORPORATION, Nagano (JP)

(72) Inventors: Natsuki Iguchi, Nagano (JP); Kazuhisa Ushiyama, Nagano (JP); Yasuhiro Kamijo, Nagano (JP)

(73) Assignee: KOA CORPORATION, Nagano (JP)

( * ) Notice: Subject to any disclaimer, the term of this patent is extended or adjusted under 35 U.S.C. 154(b) by 0 days.

(21) Appl. No.: 16/980,539

(22) PCT Filed: Mar. 19, 2019

(86) PCT No.: PCT/JP2019/011572
§ 371 (c)(1),
(2) Date: Sep. 14, 2020

(87) PCT Pub. No.: WO2019/181974
PCT Pub. Date: Sep. 26, 2019

(65) Prior Publication Data

US 2021/0005361 A1 Jan. 7, 2021

(30) Foreign Application Priority Data

Mar. 23, 2018 (JP) ..... JP2018-055880

(51) Int. Cl.
*H01C 1/084* (2006.01)
*H01C 1/146* (2006.01)
(Continued)

(52) U.S. Cl.
CPC ..... *H01C 1/084* (2013.01); *H01C 1/146* (2013.01); *H01C 17/006* (2013.01); *H01C 17/242* (2013.01)

(58) Field of Classification Search
CPC .... H01C 17/242; H01C 17/006; H01C 1/146; H01C 1/084
See application file for complete search history.

(56) References Cited

U.S. PATENT DOCUMENTS 5,043,694 A * 8/1991 Higashi ..... H01C 17/24 338/195
5,874,887 A * 2/1999 Kosinski ..... H01C 17/24 29/610.1
(Continued)

FOREIGN PATENT DOCUMENTS

JP 2000-340401 A 12/2000
JP 2001-203101 A 7/2001
(Continued)

OTHER PUBLICATIONS

JP2018-195637; machine translation. (Year: 2018).*
(Continued)

*Primary Examiner* — Kyung S Lee
(74) *Attorney, Agent, or Firm* — Greenblum & Bernstein, P.L.C.

(57) ABSTRACT

An object is to provide a chip resistor in which hot spots can be dispersed and the adverse effects on performance caused by microcracks can also be reduced. A chip resistor includes an insulating substrate, a resistive element, and electrodes. In the resistive element, a first trimming groove and a second trimming groove are formed. A first vertical groove of the first trimming groove and a second vertical groove of the second trimming groove are formed with a spacing in between in an X1-X2 direction. A first horizontal groove of the first trimming groove and a second horizontal groove of the second trimming groove extend in directions approaching each other, and terminal ends of the first horizontal groove and the second horizontal groove are formed to be separated in the X1-X2 direction such that the first horizontal groove and the second horizontal groove do not overlap in a Y1-Y2 direction.

2 Claims, 6 Drawing Sheets

(51) Int. Cl.
*H01C 17/00* (2006.01)
*H01C 17/242* (2006.01)

(56) References Cited

U.S. PATENT DOCUMENTS 6,107,909 A * 8/2000 Kosinski ..... H01C 17/24
29/610.1
6,462,304 B2 * 10/2002 Kaida ..... H01C 17/242
219/121.69
9,460,834 B2 * 10/2016 Croci ..... G01L 25/00

FOREIGN PATENT DOCUMENTS

JP 2013-179212 A 9/2013
JP 2018195637 A * 12/2018

OTHER PUBLICATIONS

International Search Report, dated Jun. 4, 2019 from the Japan Patent Office (JPO), in International Application No. PCT/JP2019/011572.

* cited by examiner

CHIP RESISTOR

TECHNICAL FIELD

The present invention relates to a chip resistor.

BACKGROUND ART

In general, a chip resistor includes an insulating substrate, a resistive element formed on the surface of the insulating substrate, and electrodes disposed on either side of the resistive element.

In a method of manufacturing a chip resistor, large numbers of electrodes and resistive elements are formed on a large-sized substrate, and thereafter, the large-sized substrate is divided to obtain a large number of chip resistors.

The resistive elements are formed in large quantity by printing and baking a resistive paste on the surface of the large-sized substrate. At this time, inconsistencies easily occur in the resistance values of the resistive elements due to factors such as deposition inconsistencies and permeation during printing or uneven temperatures inside the baking furnace.

Consequently, resistance value adjustment work is performed to form trimming grooves on the resistive elements and set each resistive element to have a predetermined resistance value while in the large-sized substrate state.

According to Patent Literature 1, approximately L-shaped trimming grooves for rough adjustment and fine adjustment are formed in a resistive element.

The invention described in Patent Literature 1 is characterized by a configuration that causes the trimming groove for rough adjustment and the trimming groove for fine adjustment to intersect near the center of the resistive element.

CITATION LIST

Patent Literature

Patent Literature 1: Japanese Patent Laid-Open No. 2000-340401

SUMMARY OF INVENTION

Technical Problem

However, if the trimming grooves are formed to intersect each other near the center of the resistive element, the potential distribution becomes concentrated (the electric field becomes stronger) in the center of the resistive element, and a hotspot occurs in the center of the resistive element. Because such a configuration causes a hotspot to occur in the center of the resistive element distant from the electrodes, heat dissipation is lowered.

In addition, inserting trimming grooves into the resistive element causes the problem of microcracks after trimming, which hinder the electrical characteristics and durability of the resistive element. Microcracks are produced at the terminal ends of the trimming grooves when the trimming is drawn into the resistive element from an edge of the resistive element. Consequently, the adverse effects on performance caused by microcracks occurring at the terminal ends of the trimming grooves must be reduced.

Accordingly, in light of the above issues, a particular object of the present invention is to provide a chip resistor in which hot spots can be dispersed and the adverse effects on performance caused by microcracks can also be reduced.

Solution to Problem

A chip resistor of the present invention includes a substrate, a resistive element formed on a surface of the substrate, and electrodes formed on either side of the resistive element. In the resistive element, at least a first trimming groove and a second trimming groove are formed. The first trimming groove and the second trimming groove have respective vertical grooves that extend orthogonally from one edge of the resistive element that faces a direction orthogonal to a direction between the electrodes, and additionally have horizontal grooves bent from the vertical grooves and extending in the direction between the electrodes. The first vertical groove of the first trimming groove and the second vertical groove of the second trimming groove are formed with a spacing in between in the direction between the electrodes. The first horizontal groove of the first trimming groove and the second horizontal groove of the second trimming groove extend in directions approaching each other, and in addition, terminal ends of the first horizontal groove and the second horizontal groove are formed to be separated in the direction between the electrodes such that the first horizontal groove and the second horizontal groove do not overlap in the orthogonal direction.

Advantageous Effects of Invention

According to the chip resistor of the present invention, hotspots can be dispersed, while in addition, the adverse effects on performance caused by microcracks can be reduced.

DESCRIPTION OF EMBODIMENTS

Hereinafter, an embodiment for carrying out the present invention (hereinafter abbreviated to the "embodiment") will be described in detail. Note that the present invention is not limited to the following embodiment, and may also be modified in various ways while remaining within the scope of the present invention.

<Chip Resistor>

Figure 1:
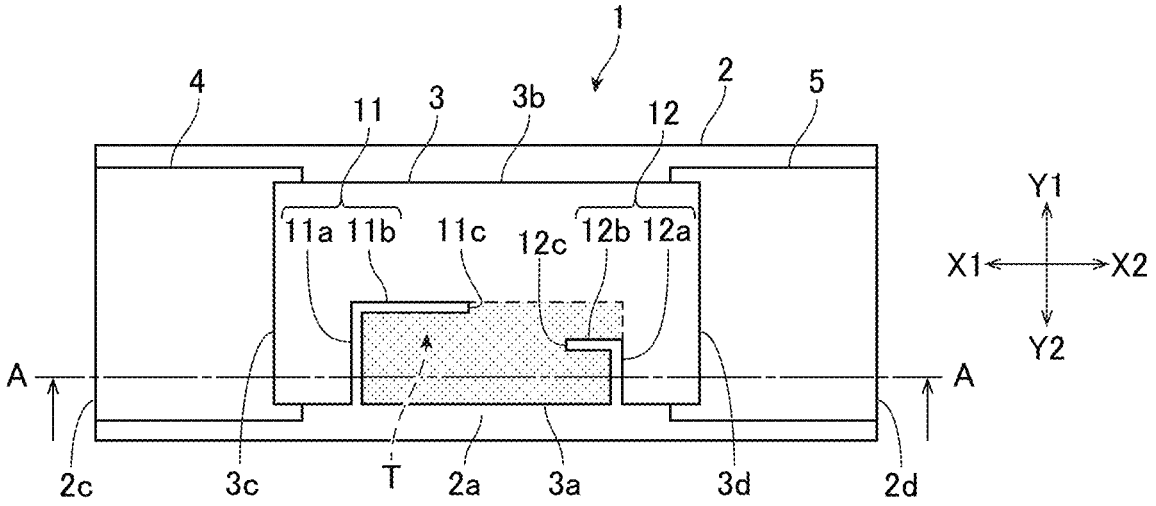
FIG. 1 is a plan view of a chip resistor according to the present embodiment.
Figure 2:
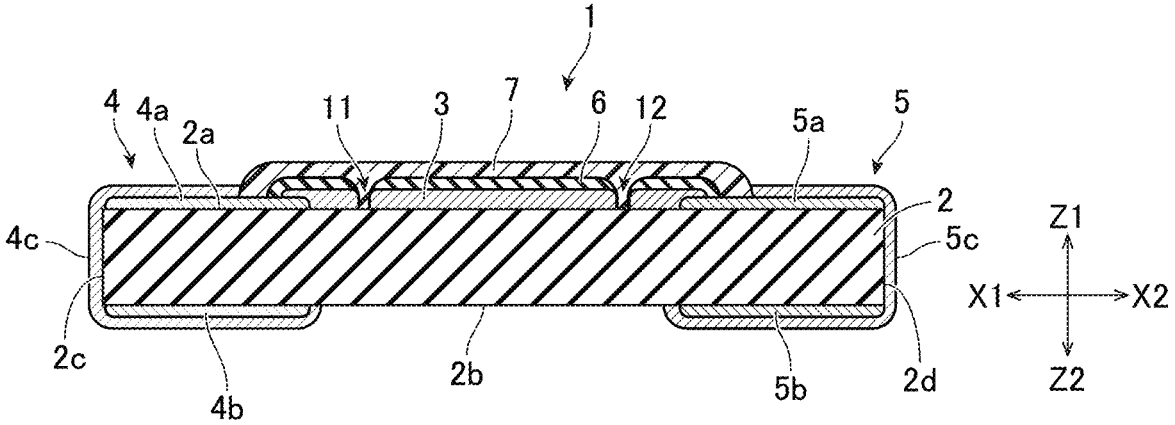
FIG. 2 is a cross-section of the chip resistor according to the embodiment, in which the section is taken along the line A-A illustrated in FIG. 1 and viewed from the direction of the arrows.

FIG. 1 is a plan view of a chip resistor according to the embodiment. FIG. 2 is a cross-section of the chip resistor according to the embodiment, in which the section is taken along the line A-A illustrated in FIG. 1 and viewed from the direction of the arrows.

(Components of Chip Resistor)

The X1-X2 direction illustrated in FIGS. 1 and 2 is the direction between electrodes, or in other words the horizontal direction, with the X1 direction going to the left and the X2 direction going to the right. In the following, this direction is mainly referred to as the horizontal direction (X1-X2). The Y1-Y2 direction illustrated in FIG. 1 is the direction orthogonal to the X1-X2 direction, or in other words the vertical direction. Hereinafter, this direction is mainly referred to as the vertical direction (Y1-Y2). The Z1-Z2 direction illustrated in FIG. 2 is the height direction orthogonal to the X1-X2 direction and the Y1-Y2 direction, with the Z1 direction being the direction going toward the front surface of a chip resistor 1 and the Z2 direction being the direction going toward the back surface of the chip resistor 1.

As illustrated in FIGS. 1 and 2, the chip resistor 1 includes an insulating substrate 2, a resistive element 3 formed on a front surface 2*a* of the insulating substrate 2, and a pair of electrodes 4 and 5 disposed on either side in the horizontal direction (X1-X2) of the resistive element 3.

As illustrated in FIGS. 1 and 2, the insulating substrate 2 is tabular, for example, but the shape of the insulating substrate 2 is not limited thereto. As illustrated in FIGS. 1 and 2, the insulating substrate 2 has a front surface 2*a*, a back surface 2*b*, and side faces surrounding the area between the front surface 2*a* and the back surface 2*b*. Of the side faces, in FIGS. 1 and 2, the left side face is labeled 2*c* while the right side face is labeled 2*d*.

The insulating substrate 2 contains a material such as ceramic, and the insulating substrate 2 is plurally obtained by dividing a large-sized substrate described later along horizontal and vertical dividing grooves.

As illustrated in FIG. 1, the resistive element 3 is formed for example in a rectangular shape on the front surface 2*a* of the insulating substrate 2. As illustrated in FIG. 1, the resistive element 3 has a first edge 3*a* positioned on the Y2 side and extending in the horizontal direction (X1-X2), a second edge 3*b* positioned on the Y1 side and extending in the horizontal direction (X1-X2), a left edge 3*c* that joins the left ends of the first edge 3*a* and the second edge 3*b* and extends in the vertical direction (Y1-Y2), and a right edge 3*d* that joins the right ends of the first edge 3*a* and the second edge 3*b* and extends in the vertical direction (Y1-Y2). Note that the plan-view shape of the resistive element 3 illustrated in FIG. 1 is an example.

The resistive element 3 is obtained by screen-printing and drying/baking a resistive paste such as Cu—Ni or ruthenium oxide, for example.

The first electrode 4 disposed on the left side has an upper electrode 4*a* formed on the front surface 2*a* of the insulating substrate 2, a lower electrode 4*b* formed on the back surface 2*b* of the insulating substrate 2 in correspondence with the upper electrode 4*a*, and a side-face electrode 4*c* that electrically connects the upper electrode 4*a* and the lower electrode 4*b* and is formed on the left side face 2*c*. On the surface of the side-face electrode 4*c*, an electrode plating layer is formed.

Similarly, the second electrode 5 disposed on the right side has an upper electrode 5*a* formed on the front surface 2*a* of the insulating substrate 2, a lower electrode 5*b* formed on the back surface 2*b* of the insulating substrate 2 in correspondence with the upper electrode 5*a*, and a side-face electrode 5*c* that electrically connects the upper electrode 5*a* and the lower electrode 5*b* and is formed on the right side face 2*d*. On the surface of the side-face electrode 5*c*, an electrode plating layer is formed.

As illustrated in FIG. 2, the upper electrodes 4*a* and 5*a* are formed separated on the left and right on the front surface 2*a* of the insulating substrate 2. The resistive element 3 is formed on the front surface 2*a* of the insulating substrate 2 to partially overlap with the upper electrodes 4*a* and 5*a*.

The upper electrodes 4*a* and 5*a* and the lower electrodes 4*b* and 5*b* are formed by screen-printing and drying/baking Ag paste, for example. The side-face electrodes 4*c* and 5*c* are formed by applying and drying/baking Ag paste on the side faces 2*c* and 2*d* of the insulating substrate 2, or by sputtering a material such as Ni/Cr instead of Ag paste, for example. Additionally, an electrode plating layer such as Ni, Au, or Sn is formed on the surfaces of the side-face electrodes 4*c* and 5*c*.

Also, as illustrated in FIG. 2, a first overcoat layer 6 is formed on the surface of the resistive element 3. Furthermore, a second overcoat layer 7 is formed on the surface of the first overcoat layer 6. With this arrangement, the resistive element 3 can be protected from the external environment. For example, the first overcoat layer 6 contains glass as a main component, while the second overcoat layer 7 is formed by screen-printing and heat-curing an epoxy resin paste.

Meanwhile, with regard to the formation of trimming grooves used to adjust the resistance value of the resistive element 3, thorough research by the inventors led to the present invention, which is capable of dispersing hotspots occurring inside the resistive element 3 while also reducing the adverse effects on performance due to microcracks.

Hereinafter, the features of a first trimming groove 11 and a second trimming groove 12 according to the embodiment will be described.

The long first trimming groove 11 illustrated in FIG. 1 is a trimming groove used for rough adjustment of the resistance value. On the other hand, the second trimming groove 12 illustrated in FIG. 1 is a trimming groove of shorter length than the first trimming groove 11 and is used for fine adjustment of the resistance value.

As illustrated in FIG. 1, the first trimming groove 11 is formed in an approximate L-shape that extends from the first edge 3*a* of the resistive element 3 toward the Y1 direction, and is also bent to the right (X2 direction) inside the resistive element 3. The first trimming groove 11 is provided with a first vertical groove 11*a* that extends in the Y1 direction and a first horizontal groove 11*b* that extends to the right (X2 direction) from the first vertical groove 11*a*.

Also, as illustrated in FIG. 1, the second trimming groove 12 is formed in an approximate L-shape that extends from the first edge 3*a* of the resistive element 3 toward the Y1 direction, and is also bent to the left (X1 direction) inside the resistive element 3. The second trimming groove 12 is provided with a second vertical groove 12*a* that extends in the Y1 direction and a second horizontal groove 12*b* that extends to the left (X1 direction) from the second vertical groove 12*a*.

As illustrated in FIG. 1, the first vertical groove 11*a* and the second vertical groove 12*a* are formed with a spacing in between in the horizontal direction (X1-X2). The first vertical groove 11*a* is formed to be longer than the second vertical groove 12*a*.

Also, as illustrated in FIG. 1, the first horizontal groove 11*b* and the second horizontal groove 12*b* are bent from the first vertical groove 11*a* and the second vertical groove 12*a*, respectively, and extend in directions approaching each other. Furthermore, terminal ends 11*c* and 12*c* of the horizontal grooves 11*b* and 12*b* are formed to be separated in the horizontal direction (X1-X2) such that the horizontal grooves 11*b* and 12*b* do not overlap in the vertical direction (Y1-Y2). Note that the first horizontal groove 11*b* is formed to be longer than the second horizontal groove 12*b*.

Here, a "terminal end" refers to an irradiation end point when performing trimming by irradiating the resistive element 3 with laser light. The irradiation start points are the positions of the trimming grooves 11 and 12 at the first edge 3*a*, and these positions correspond to the "start point" of each of the trimming grooves 11 and 12.

As illustrated in FIG. 1, the first trimming groove 11 is formed near the electrode 4 on the left side while the second trimming groove 12 is formed near the electrode 5 on the right side, such that the approximately L-shaped first trimming groove 11 and second trimming groove 12 are face each other and do not overlap in the vertical direction (Y1-Y2).

In the embodiment, hotspots occurring inside the resistive element 3 can be dispersed in association with the formation of each of the trimming grooves 11 and 12. The hotspot dispersion effect will be described using the potential distribution diagrams in FIGS. 3 and 4.

(Hotspot Dispersion Effect)

Figure 3:
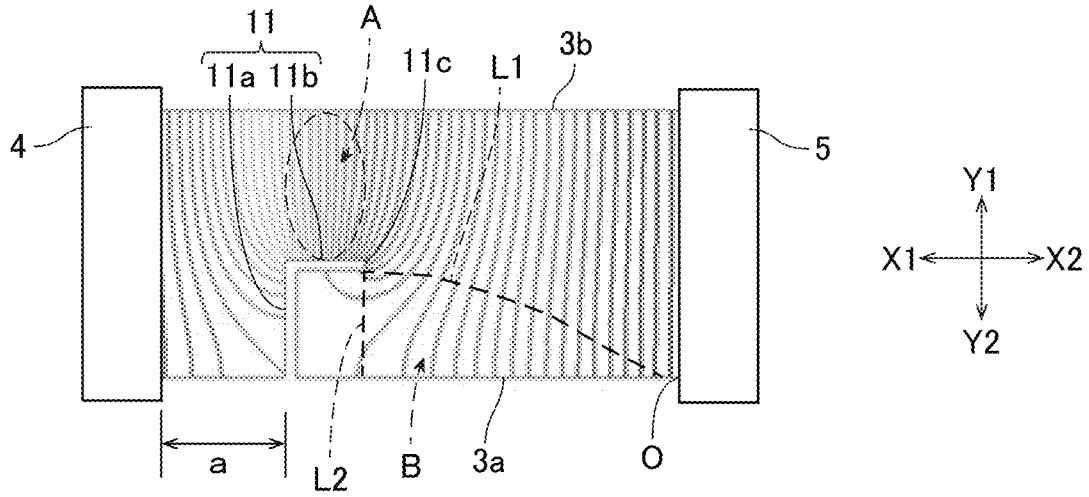
FIG. 3 is a potential distribution diagram illustrating the potential distribution when forming a first trimming groove (trimming groove for rough adjustment) in a resistive element.

FIG. 3 is a potential distribution diagram when the first trimming groove 11 is formed in the resistive element 3 as a trimming groove for rough adjustment.

As illustrated in FIG. 3, laser light is made to irradiate the resistive element 3 in the Y1 direction from the first edge 3*a* and also turn to the right (X2 direction), thereby forming the approximately L-shaped first trimming groove 11.

The first trimming groove 11 is formed to the left-of-center in the horizontal direction (X1-X2) of the resistive element 3. The first trimming groove 11 is formed to have the first vertical groove 11*a* and the first horizontal groove 11*b*. At this time, the first vertical groove 11*a* is formed at a position a distance a from the first electrode 4. Also, the first horizontal groove 11*b* is formed in the direction going away from the first electrode 4, that is, to the right (X2 direction).

As illustrated in FIG. 3, through the formation of the first trimming groove 11, the spacing in the vertical direction (Y1-Y2) between the first horizontal groove 11*b* and the second edge 3*b* of the resistive element 3 is narrower compared to other regions. Hereinafter, the space between the first horizontal groove 11*b* and the second edge 3*b* is referred to as the first region A. In this way, because the spacing in the first region A is narrower, the electric field strength in the first region A is stronger when a voltage is applied between the electrodes 4 and 5. On the other hand, the electric field strength in a region B enclosed between a first virtual line L1 joining the terminal end 11*c* of the first trimming groove 11 to an intersection point O of the second electrode 5 on the side the terminal end 11*c* faces and the first edge 3*a*, a second virtual line L2 joining the terminal end 11*c* to the first edge 3*a* in the vertical direction (Y1-Y2), and the first edge 3*a* is weaker compared to the first region A.

Here, as illustrated in FIG. 3, the first virtual line L1 is preferably defined not as a straight line, but rather as a curve that bulges in the direction of the second edge 3*b*. The first virtual line L1 is preferably at the approximate boundary position where the spacing between the equipotential lines starts to widen from the second edge 3*b* side toward the first edge 3*a* side. From the potential distribution diagram in FIG. 3, following the approximate boundary position results in a curve that bulges slightly in the direction of the second edge 3*b*. Note that treating the first virtual line L1 as a straight line is a more severe condition for stipulating the region B for forming the second trimming groove 12, and is more preferable.

Figure 4:
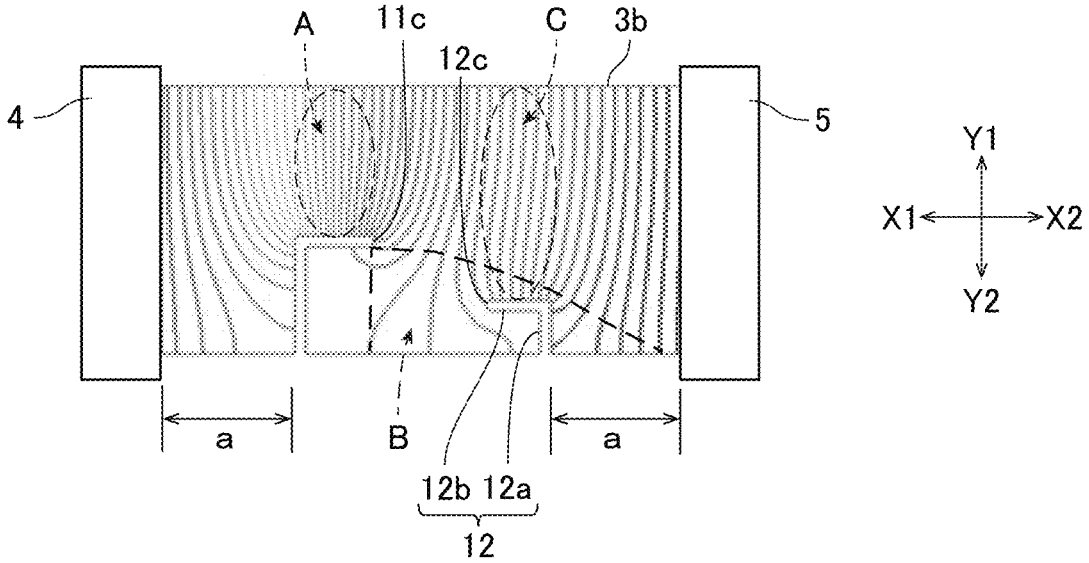
FIG. 4 is a potential distribution diagram illustrating the potential distribution when forming a second trimming groove (trimming groove for fine adjustment) in a resistive element following FIG. 3.

As illustrated in FIG. 4, in the embodiment, laser light is made to irradiate the resistive element 3 in the Y1 direction from the first edge 3*a* and also turn to the left (X1 direction), thereby forming the approximately L-shaped second trimming groove 12 for fine adjustment.

The second trimming groove 12 is formed to the right-of-center in the horizontal direction (X1-X2) of the resistive element 3. The second trimming groove 12 is approximately L-shaped formed to have the second vertical groove 12*a* and the second horizontal groove 12*b*. At this time, the spacing between the second vertical groove 12*a* and the second electrode 5 is preferably formed at a distance a substantially equal to the distance a between the first vertical groove 11*a* and the first electrode 4. Also, the terminal end 12*c* of the second horizontal groove 12*b* is formed going toward the left direction (X1). Consequently, the terminal end 11*c* of the first trimming groove 11 and the terminal end 12*c* of the second trimming groove 12 extend in directions approaching each other.

Additionally, in the embodiment, the terminal end 11*c* of the first trimming groove 11 and the terminal end 12*c* of the second trimming groove 12 are formed to be separated from each other in the horizontal direction (X1-X2) such that the first horizontal groove 11*b* of the first trimming groove 11 and the second horizontal groove 12*b* of the second trimming groove 12 do not overlap in the vertical direction (Y1-Y2).

Through the formation of the second trimming groove 12, the spacing in the vertical direction (Y1-Y2) between the second horizontal groove 12*b* and the second edge 3*b* of the resistive element 3 is narrower than other regions, except the region A. Hereinafter, the space between the second horizontal groove 12*b* and the second edge 3*b* is referred to as the second region C. In this way, the spacing in the second region C is narrower. For this reason, the electric field strength in the second region C is stronger when a voltage is applied between the electrodes 4 and 5. However, because the first region A is narrower than the second region C, the electric field strength is stronger in the first region A than in the second region C.

The first region A and the second region C where the electric field is strong are hotspots compared to the other regions where the spacing in the vertical direction (Y1-Y2) is wider.

Figure 5:
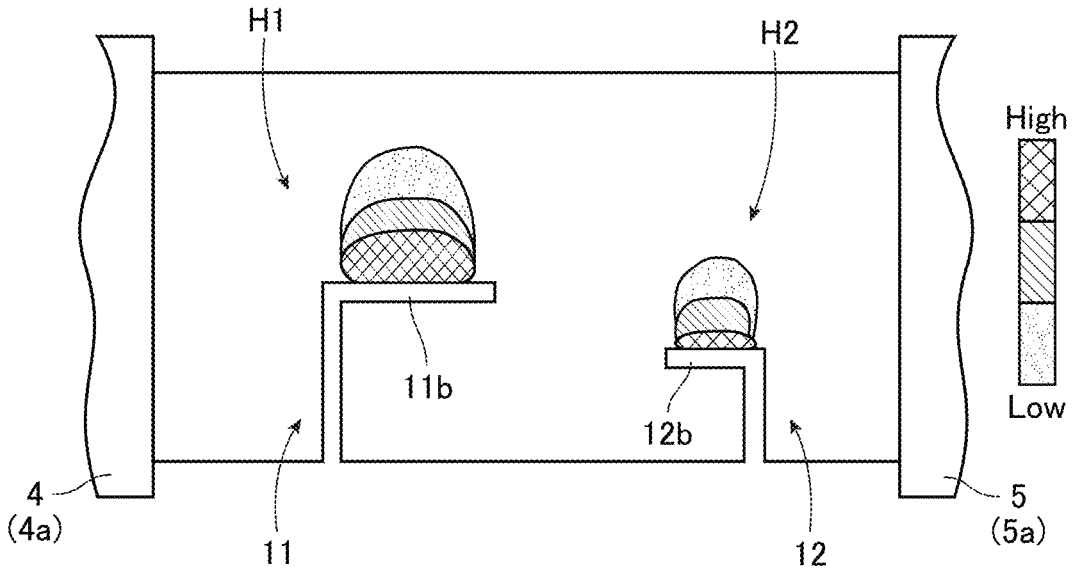
FIG. 5 is a schematic plan view of a resistive element for describing hotspots occurring in the resistive element provided with the first trimming groove and the second trimming groove.

FIG. 5 is a schematic diagram illustrating a temperature distribution inside the resistive element. As illustrated in FIG. 5, a hotspot H1 occurs near the first horizontal groove 11*b* of the first trimming groove 11. Also, a hotspot H2 occurs near the second horizontal groove 12*b* of the second trimming groove 12. As illustrated in FIG. 5, the regions of high temperature are broader near the first horizontal groove 11*b* of the first trimming groove 11 compared to near the second horizontal groove 12*b* of the second trimming groove 12.

Figure 6:
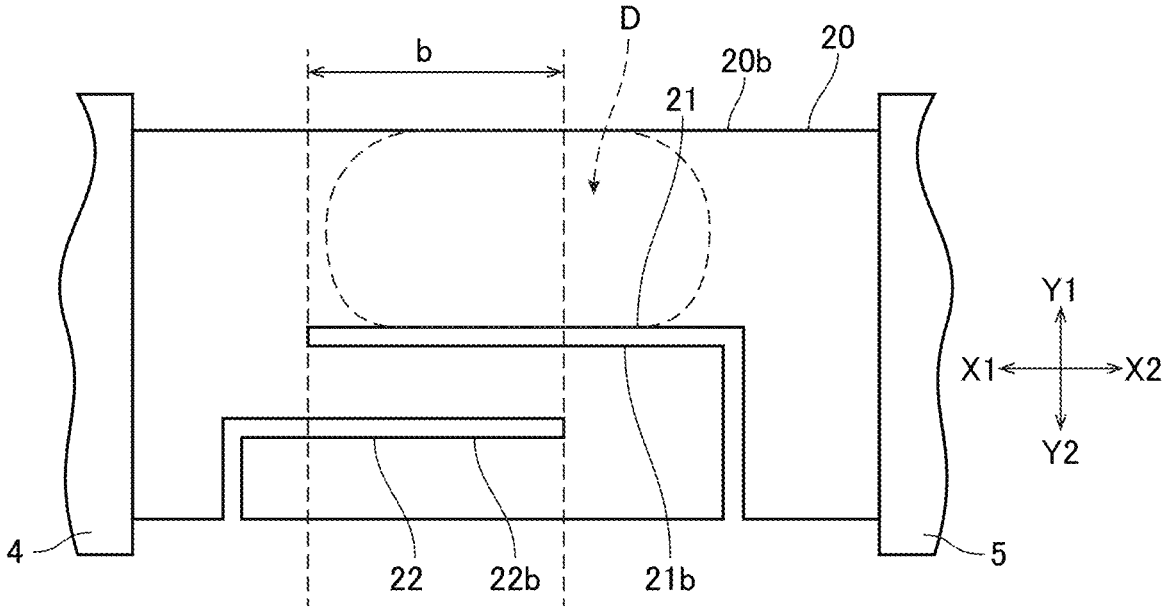
FIG. 6 is a plan view of a resistive element forming a chip resistor according to a comparative example.

As a comparative example, FIG. 6 is an example of providing trimming grooves 21 and 22 in a resistive element 20. As illustrated in FIG. 6, a portion of a first horizontal groove 21*b* of the first trimming groove 21 used for rough adjustment and a portion of a second horizontal groove 22*b* of the second trimming groove 22 used for fine adjustment overlap in the vertical direction (Y1-Y2). The overlapping width is denoted by the dimension b.

In the comparative example illustrated in FIG. 6, the spacing between the first horizontal groove 21*b* of the first trimming groove 21 and a second edge 20*b* of the resistive element 20 is narrower compared to other regions. A region D between the first horizontal groove 21*b* and the second edge 20*b* illustrated in FIG. 6 has a strong electric field and acts as a hotspot.

In the comparative example illustrated in FIG. 6, a hotspot occurs near the center in the horizontal direction (X1-X2) of the resistive element 20. In contrast, in the embodiment, as illustrated in FIG. 4, the regions A and C where the electric field is strong can be separated in the left and right direction (X1-X2). Consequently, as illustrated in FIG. 5, the hotspots H1 and H2 can be dispersed in the left and right direction.

In the comparative example illustrated in FIG. 6, because a hotspot occurs near the center of the resistive element 20, the hotspot is at a distance position from the electrodes 4 and 5. Consequently, the heat of the hotspot hardly escapes appropriately to the electrodes 4 and 5.

In contrast, in the embodiment, as illustrated in FIG. 5, the hotspots H1 and H2 can be dispersed, and the hotspot H1 occurring near the first horizontal groove 11*b* of the first trimming groove 11 can be positioned closer to the first electrode 4. Meanwhile, the hotspot H2 occurring near the second horizontal groove 12*b* of the second trimming groove 12 can be positioned closer to the second electrode 5.

Consequently, in the embodiment, the heat of the hotspot H1 can escape appropriately to the upper electrode 4*a* of the first electrode 4, while the heat of the hotspot H2 can escape appropriately to the upper electrode 5*a* of the second electrode 5.

Also, in the embodiment, the distance between the first trimming groove 11 and the lower electrode 4*b* of the first electrode 4 as well as the distance between the second trimming groove 12 and the lower electrode 5*b* of the second electrode 5 can be shortened compared to the comparative example in FIG. 6 (see FIG. 2). For this reason, the heat of the hotspot H1 easily escapes also toward the lower electrode 4*b* of the first electrode 4. Similarly, the heat of the hotspot H2 easily escapes also toward the lower electrode 5*b* of the second electrode 5.

(Microcracks)

Microcracks will be described. In the embodiment, the terminal end 11*c* of the first trimming groove 11 and the terminal end 12*c* of the second trimming groove 12 are made to extend in directions approaching each other. For this reason, at least some of the microcracks occurring at the terminal ends 11*c* and 12*c* stretch into the region where current does not flow between the trimming grooves 11 and 12. As a result, change over time in the resistance value can be suppressed appropriately. This property will be described in further detail.

In the embodiment, as illustrated in FIG. 4, the second trimming groove 12 for fine adjustment is formed in the region B whose width in the vertical direction (Y1-Y2) gradually narrows from the terminal end 11*c* of the first trimming groove 11 to the second electrode 5. The region B is a region where current does not flow or at least a region where current flows less easily compared to other regions. Moreover, in the embodiment, the terminal end 12*c* of the second trimming groove 12 is provided in a direction going toward the terminal end 11*c* of the first trimming groove 11. For this reason, microcracks occurring at the terminal end 12*c* of the second trimming groove 12 stretch toward the widening side of spacing in the vertical direction (Y1-Y2) of the region B. Consequently, change over time in the resistance value is unaffected by the microcracks occurring in the second trimming groove 12, or is at least minimally affected by the microcracks.

Also, some of the microcracks occurring at the terminal end 11*c* of the first trimming groove 11 easily stretch inside the region B. For this reason, the adverse effects of the microcracks occurring at the first trimming groove 11 can also be suppressed as much as possible.

As above, according to the configuration of the embodiment, the hotspots H1 and H2 can be dispersed and heat dissipation can be improved, while in addition, the adverse effects on performance by the microcracks occurring at the terminal ends 11*c* and 12*c* of the trimming grooves 11 and 12 can be reduced.

In the embodiment, as illustrated in FIG. 4, the distance a between the first vertical groove 11*a* of the first trimming groove 11 and the first electrode 4 is preferably substantially equal to the distance a between the second vertical groove 12*a* of the second trimming groove 12 and the second electrode 5. "Substantially equal" is defined such that the value obtained by dividing one distance a by the other distance a is within approximately 0.9 to 1.1. Also, the distances a are preferably equal to each other. Note that "equal" is a concept that allows for manufacturing error.

According to this configuration, the potential distribution occurring inside the resistive element 3 is better balanced left and right. Also, a balanced diffusion of electrode material from the electrodes 4 and 5 to the resistive element 3 due to heat during trimming occurs on either side. With this arrangement, variations in the temperature coefficient of resistance (TCR) due to trimming can be suppressed.

Other Embodiments

Next, other embodiments will be described. In the embodiment illustrated in FIG. 7, a first trimming groove 31 and a second trimming groove 32 are formed having substantially the same length. In other words, a first vertical groove 31*a* of the first trimming groove 31 and a second vertical groove 32*a* of the second trimming groove 32 are substantially the same in length as each other. Also, a first horizontal groove 31*b* of the first trimming groove 31 and a second horizontal groove 32*b* of the second trimming groove 32 are formed having substantially the same length as each other.

Figure 7:
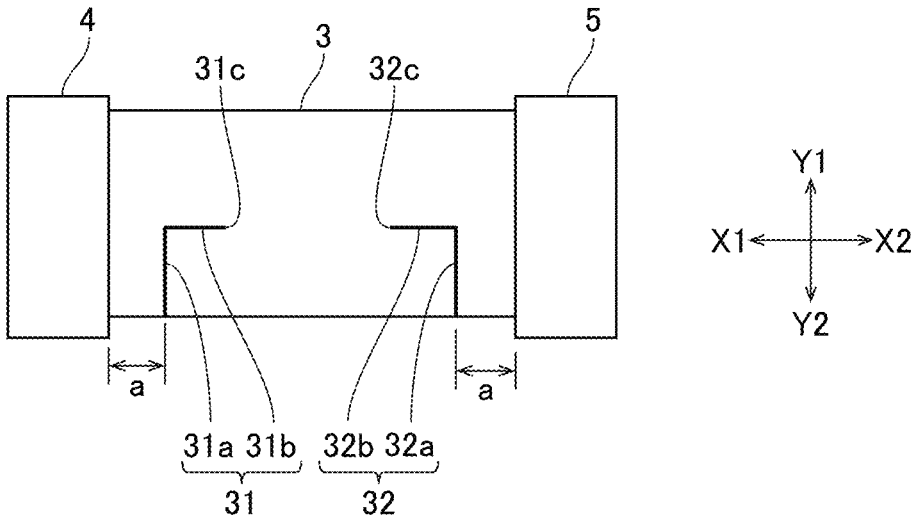
FIG. 7 is a plan view of a chip resistor according to a different embodiment.

In the embodiment illustrated in FIG. 7, like the embodiment illustrated in FIG. 1, the first horizontal groove 31*b* of the first trimming groove 31 and the second horizontal groove 32*b* of the second trimming groove 32 extend in directions approaching each other. Additionally, terminal ends 31*c* and 32*c* are formed to be separated in the horizontal direction (X1-X2) such that the first horizontal groove 31*b* and the second horizontal groove 32*b* do not overlap in the vertical direction (Y1-Y2 direction).

Also, in the embodiment illustrated in FIG. 7, the distance a between the first vertical groove 31*a* of the first trimming groove 31 and the first electrode 4 is preferably substantially equal to the distance a between the second vertical groove 32*a* of the second trimming groove 32 and the second electrode 5.

In the embodiment illustrated in FIG. 7, hotspots likewise can be dispersed left and right and heat dissipation can be improved, while in addition, the adverse effects on performance by the microcracks occurring at the terminal ends 31*c* and 32*c* of the trimming grooves 31 and 32 can be reduced. However, with regard to microcracks, the configuration of FIG. 1 can reduce the adverse effects of microcracks more effectively than the configuration of FIG. 7.

Figure 8:
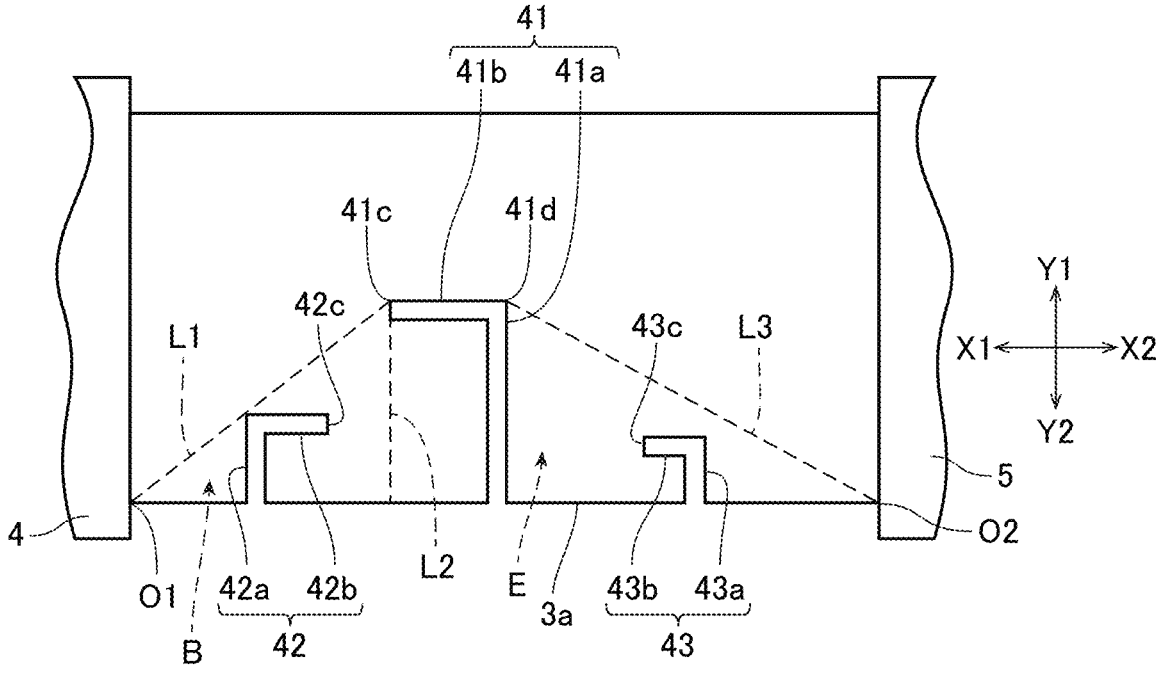
FIG. 8 is a plan view of a chip resistor according to a different embodiment.

In another embodiment illustrated in FIG. 8, three trimming grooves are formed. A first trimming groove 41 illustrated in FIG. 8 is a trimming groove used for rough adjustment, while a second trimming groove 42 and a third trimming groove 43 are trimming grooves used for fine adjustment.

The first trimming groove 41 is approximately L-shaped, extending from the first edge 3*a* of the resistive element 3 in the Y1 direction and also bent to the left (X1 direction). The first trimming groove 41 is formed to have a first vertical groove 41*a* and a first horizontal groove 41*b*.

The second trimming groove 42 is approximately L-shaped, extending from the first edge 3*a* of the resistive element 3 in the Y1 direction and also bent to the right (X2 direction). The second trimming groove 42 is formed to have a second vertical groove 42*a* and a second horizontal groove 42*b*.

As illustrated in FIG. 8, the first horizontal groove 41*b* of the first trimming groove 41 and the second horizontal groove 42*b* of the second trimming groove 42 extend in directions approaching each other, while in addition, terminal ends 41*c* and 42*c* are formed to be separated in the horizontal direction (X1-X2) such that the first horizontal groove 41*b* and the second horizontal groove 42*b* do not overlap in the vertical direction (Y1-Y2).

As illustrated in FIG. 8, the second trimming groove 42 and the third trimming groove 43 for fine adjustment are formed on the left and right sides with the first trimming groove 41 in between.

As illustrated in FIG. 8, the third trimming groove 43 is approximately L-shaped, extending from the first edge 3*a* of the resistive element 3 in the Y1 direction and also bent to the left (X1 direction). The third trimming groove 43 is formed to have a third vertical groove 43*a* and a third horizontal groove 43*b*.

In FIG. 8, the trimming lengths are set such that the first trimming groove 41 is the longest, the second trimming groove 42 is the next-longest, and the third trimming groove 43 is the shortest. The third trimming groove 43 may also be comparable in length to the second trimming groove 42.

As illustrated in FIG. 8, the second trimming groove 42 is formed in a region B enclosed between a first virtual line L1 joining the terminal end 41*c* of the first trimming groove 41 to an intersection point O1 of the first electrode 4 on the side the terminal end 41*c* faces and the first edge 3*a*, a second virtual line L2 drawn from the terminal end 41*c* to the first edge 3*a* in the vertical direction (Y1-Y2), and the first edge 3*a*.

Also, a third trimming groove 43 is formed in a region E enclosed between a third virtual line L3 joining a terminal end 41*d* of the first trimming groove 41 to an intersection point O2 of the second electrode 5 and the first edge 3*a*, the first vertical groove 41*a* of the first trimming groove 41, and the first edge 3*a*.

In the embodiment illustrated in FIG. 8, the trimming grooves 41, 42, and 43 do not overlap each other in the vertical direction (Y1-Y2), and hotspots can be dispersed left and right. Consequently, heat dissipation can be improved. In addition, the adverse effects on performance by microcracks occurring at the terminal ends 41*c*, 42*c*, and 43*c* of the trimming grooves 41, 42, and 43 can be reduced.

In the embodiment, four or more trimming grooves may also be formed. Trimming grooves for fine adjustment can be formed in each of the regions B and E formed to the left and right of the first trimming groove 41 illustrated in FIG. 8. At this time, by causing the horizontal grooves of the trimming grooves for fine adjustment to extend toward the first trimming groove 41 for rough adjustment, the adverse effects on performance by microcracks can be reduced effectively.

<Method of Manufacturing Chip Resistor>

FIG. 9 is a plan view illustrating steps for manufacturing the chip resistor according to the embodiment.

Figure 9A:
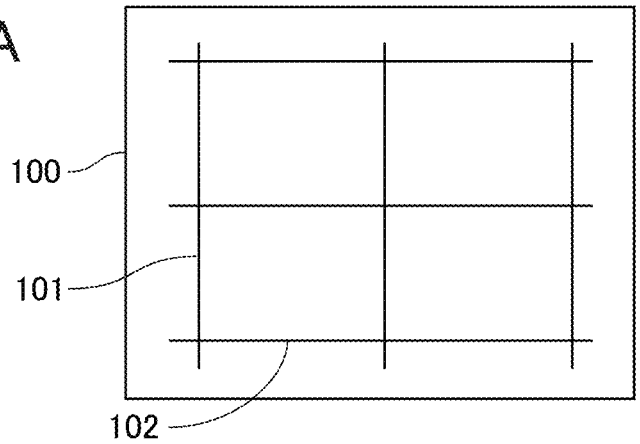
FIG. 9A is a plan view illustrating a step of manufacturing a chip resistor according to the embodiment.

In FIG. 9A, first, a large-sized substrate 100 from which to obtain a plurality of the insulating substrate 2 is prepared. In the large-sized substrate 100, a grid of first dividing grooves 101 and second dividing grooves 102 are provided in advance. Thereafter, each of the cells partitioned by the first dividing grooves 101 and the second dividing grooves 102 becomes a single chip region.

Figure 9B:
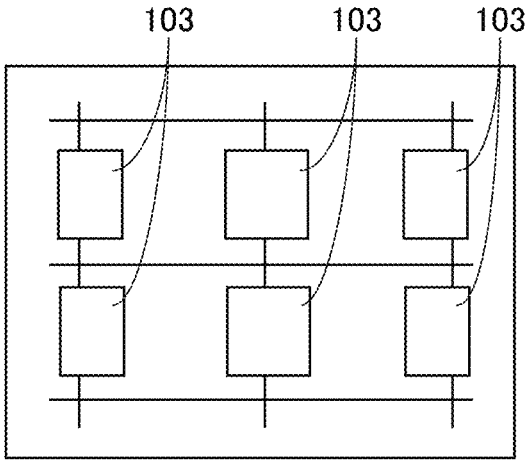
FIG. 9B is a plan view illustrating the next manufacturing step after FIG. 9A.

In the step illustrated in FIG. 9B, a plurality of electrode layers 103 forming the respective upper electrodes 4*a* and 5*a* of the first electrode 4 and the second electrode 5 are formed at predetermined positions on the front surface of the large-sized substrate 100. Also, although not illustrated, electrode layers forming the respective lower electrodes 4*b* and 5*b* of the first electrode 4 and the second electrode 5 are formed at predetermined positions on the back surface of the large-sized substrate 100. The electrode layers 103 can be formed by screen-printing Ag paste onto the large-sized substrate 100, and then drying/baking the Ag paste, for example.

Figure 9C:
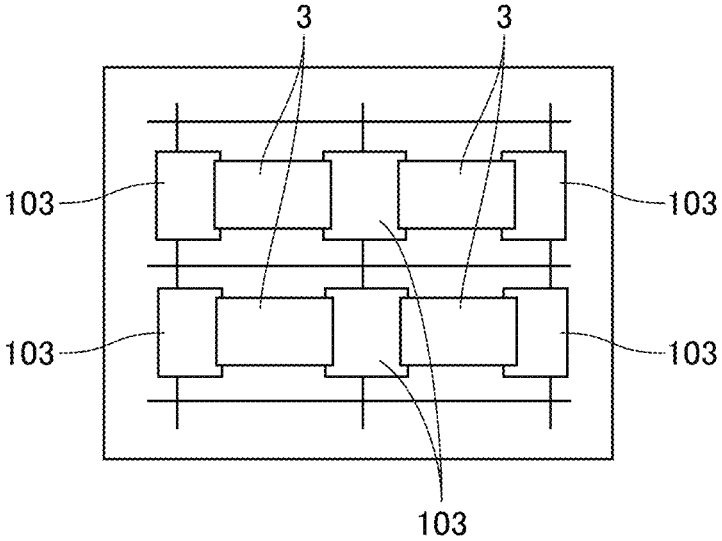
FIG. 9C is a plan view illustrating the next manufacturing step after FIG. 9B.

Next, in the step illustrated in FIG. 9C, the resistive element 3 is formed on the surface of the large-sized substrate 100 in each region between the electrode layers 103 by screen-printing and drying/baking a resistive paste such as Cu—Ni or ruthenium oxide. With this arrangement, the electrode layers 103 can be connected through each resistive element 3.

Figure 10A:
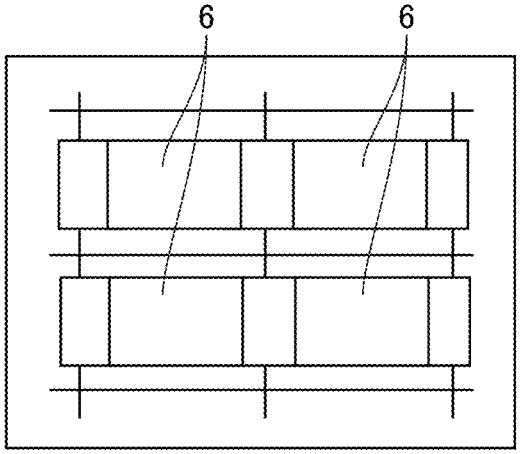
FIG. 10A is a plan view illustrating the next manufacturing step after FIG. 9C.

Next, in the step illustrated in FIG. 10A, the first overcoat layer 6 that covers the resistive elements is formed by screen-printing and drying/baking a glass paste from the surface of the resistive elements 3.

Figure 10B:
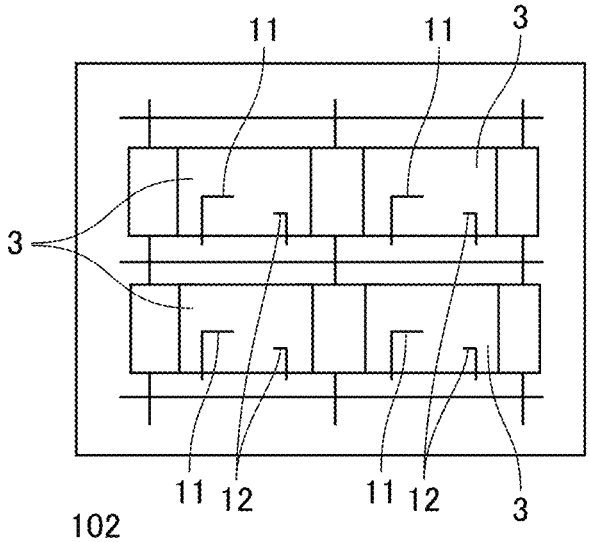
FIG. 10B is a plan view illustrating the next manufacturing step after FIG. 10A.

Next, in the step illustrated in FIG. 10B, the first trimming groove 11 for rough adjustment is formed in each resistive element 3 to roughly adjust the resistance value of the resistive element 3 to a value somewhat lower than a target resistance value.

Next, the second trimming groove 12 for fine adjustment is formed in each resistive element 3 to finely adjust the resistance value of the resistive element 3 to the target resistance value. For example, the second trimming groove 12 is formed to finely adjust the resistance value of the resistive element 3 to a resistance value slightly lower than the target resistance value. After that, the third trimming groove may be formed as a finishing adjustment that raises the resistance value to the target resistance value.

With regard to the formation of the first trimming groove 11 and the second trimming groove 12, as described already using FIGS. 3 and 4, the first horizontal groove 11*b* of the first trimming groove 11 and the second horizontal groove 12*b* of the second trimming groove 12 are made to extend in directions approaching each other. Furthermore, the terminal ends 11*c* and 12*c* of the first trimming groove 11 and the second trimming groove 12 are formed to be separated in the horizontal direction such that the first trimming groove 11 and the second trimming groove 12 do not overlap in the vertical direction.

Note that the trimming groove is formed in resistive element 3 and the first overcoat layer 6 that covers the surface of the resistive element 3 (see FIG. 2). In FIG. 10B, the first overcoat layer 6 is not illustrated, and the first trimming groove 11 and the second trimming groove 12 formed in each resistive element 3 are illustrated.

Figure 10C:
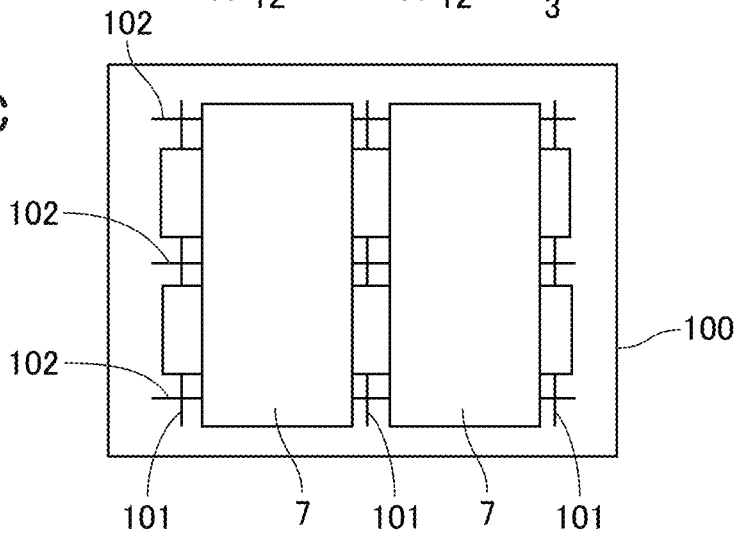
FIG. 10C is a plan view illustrating the next manufacturing step after FIG. 10B.

Next, in the step illustrated in FIG. 10C, the second overcoat layer 7 is formed on top of the first overcoat layer 6 that covers the surface of each resistive element. The second overcoat layer 7 can be formed by screen-printing an epoxy resin paste and then performing a heat treatment, for example.

Next, the large-sized substrate 100 illustrated in FIG. 10C is divided into strips along the first dividing grooves 101 (first dividing step). With this division, a strip substrate (not illustrated) containing a connected plurality of chip resistors is obtained. Thereafter, Ag paste is applied and dried/baked on the divided faces of the strip substrate, or Ni/Cr is sputtered instead of Ag paste. With this arrangement, the side-face electrode (not illustrated in FIG. 10C, but refer to the side-face electrode 5*c* in FIG. 2) that electrically connects the upper electrodes and the lower electrodes is formed.

Figure 10D:
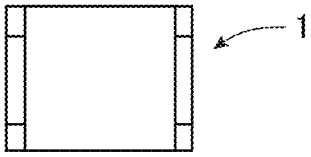
FIG. 10D is a plan view illustrating the next manufacturing step after FIG. 10C.

Next, each strip substrate is divided along the second dividing grooves 102 (second dividing step). With this division, a plurality of chip resistors 1 can be obtained. Finally, by electroplating the electrode surfaces of the individualized chip resistor 1 illustrated in FIG. 10D with a material such as Ni, Au, and Sn, the chip resistor 1 illustrated in FIGS. 1 and 2 can be obtained.

According to the method of manufacturing the chip resistor 1 of the embodiment, when trimming the resistive element 3 to adjust the resistance, the second trimming groove 12 for fine adjustment is formed after forming the first trimming groove 11 for rough adjustment. At this time, the second horizontal groove 12*b* of the second trimming groove 12 is formed to approach the first horizontal groove 11*b* of the first trimming groove 11, while in addition, the terminal end 11*c* of the first trimming groove 11 and the terminal end 12*c* of the second trimming groove 12 are formed to be separated in the horizontal direction (X1-X2) such that the first horizontal groove 11*b* and the second horizontal groove 12*b* do not overlap in the vertical direction (Y1-Y2) (see FIG. 4).

With this arrangement, hotspots occurring inside the resistive element 3 can be dispersed in the left and right direction, while in addition, it is possible to appropriately suppress the adverse effects on performance by microcracks occurring at the terminal ends 11*c* and 12*c*.

As above, according to the method of manufacturing a chip resistor of the embodiment, a chip resistor having excellent heat dissipation and for which the amount of change in the temperature coefficient of resistance (TCR) after trimming is precisely adjustable to a target value can be manufactured appropriately and easily.

Example

Hereinafter, the present invention will be described in further detail on the basis of an example. However, the present invention is not limited in any way by the following example.

In an experiment, the first trimming groove 11 and the second trimming groove 12 were formed in the resistive element 3 according to the procedure illustrated in FIGS. 3 and 4, and the resistance value was adjusted.

The length dimension in the horizontal direction (X1-X2) of the resistive element 3 used in the experiment was 1000 μm, and the length dimension in the vertical direction was 500 μm. Here, the "length dimension in the horizontal direction (X1-X2) of the resistive element 3" refers to the horizontal width of the resistive element 3 not overlapping with the electrodes.

The dimension of the distance a illustrated in FIGS. 3 and 4 as well as a trimming region T of the resistive element 3 are stipulated. The trimming region T can be computed as a percentage, where 100% is the area of the resistive element 3 not overlapping with the electrodes 4 and 5. The trimming region T is illustrated in FIG. 1.

For example, it was determined that if the target value of the amount of change in the temperature coefficient of resistance (TCR) is approximately ±10 ppm, then for the size of the resistive element 3 in this example, the dimension of the distance a needs to be set to approximately 100 μm, and the trimming region T needs to be set to approximately 40%.

In the example, as illustrated in FIG. 1, the trimming region T is the region containing 40% of the area excluding the distance a on either side from among the 50% of the area on the first edge 3*a* side of the resistive element 3 when the resistive element 3 is divided in half in the vertical direction (Y1-Y2).

Inside the trimming region T, the first trimming groove 11 used for rough adjustment is formed by laser irradiation, and then the second trimming groove 12 used for fine adjustment is formed by laser irradiation. The second trimming groove 12 is formed inside the region B enclosed between the first virtual line L1, the second virtual line L2, and the first edge 3*a* illustrated in FIGS. 3 and 4.

As illustrated in FIGS. 3 and 4, the first horizontal groove 11*b* of the first trimming groove 11 and the second horizontal groove 12*b* of the second trimming groove 12 extend in directions approaching each other, while in addition, the terminal ends 11*c* and 12*c* are formed to be separated in the horizontal direction (X1-X2) such that the first horizontal groove 11*b* and the second horizontal groove 12*b* do not overlap in the vertical direction (Y1-Y2). Furthermore, in this example, ratio of the length of the first horizontal groove 11*b* of the first trimming groove 11 with respect to the length of the second horizontal groove 12*b* of the second trimming groove 12 was adjusted to be 2:1.

When a voltage was applied between the electrodes 4 and 5 to the trimmed chip resistor and a thermo tracer was used to check for hotspots inside the resistive element 3, the hotspots were confirmed to be dispersed in the left and right direction (X1-X2).

Additionally, it was demonstrated that the amount of change in the temperature coefficient of resistance (TCR) after trimming can be kept within ±10 ppm.

A characteristic configuration of the embodiment is summarized below. The chip resistor 1 of the embodiment includes the insulating substrate 2, the resistive element 3 formed on the front surface of the insulating substrate 2, and the electrodes 4 and 5 formed on either side of the resistive element 3. In the resistive element 3, at least the first trimming groove 11 and the second trimming groove 12 are formed. The first trimming groove 11 and the second trimming groove 12 have respective vertical grooves 11*a* and 12*a* that extend orthogonally from the one edge 3*a* of the resistive element 3 that faces the direction orthogonal to the direction between the electrodes, and additionally have horizontal grooves 11*b* and 12*b* bent from the vertical grooves 11*a* and 12*a* and extending in the direction between the electrodes. The first vertical groove 11*a* of the first trimming groove 11 and the second vertical groove 12*a* of the second trimming groove 12 are formed with a spacing in between in the direction between the electrodes. The first horizontal groove 11*b* of the first trimming groove 11 and the second horizontal groove 12*b* of the second trimming groove 12 are characterized by extending in directions approaching each other, and in addition, the terminal ends 11*c* and 12*c* of the first horizontal groove 11*b* and the second horizontal groove 12*b* are formed to be separated in the direction between the electrodes such that the first horizontal groove 11*b* and the second horizontal groove 12*b* do not overlap in the orthogonal direction.

In the embodiment, the second trimming groove 12 is preferably formed inside the region B enclosed between the first virtual line L1 joining the terminal end 11*c* of the first horizontal groove 11*b* of the first trimming groove 11 to the intersection point O of the electrode 5 on the side the terminal end 11*c* faces and the one edge 3*a*, the second virtual line L2 joining the terminal end 11*c* to the one edge 3*a* in the orthogonal direction, and the one edge 3*a*.

In the embodiment, the distance a between the first vertical groove 11*a* of the first trimming groove 11 and the electrode 4 on the side near the first vertical groove 11*a* is preferably substantially equal to the distance a between the second vertical groove 12*a* of the second trimming groove 12 and the electrode 5 on the side near the second vertical groove 12*a*.

INDUSTRIAL APPLICABILITY

The chip resistor of the present invention has excellent heat dissipation, and furthermore, the change over time in the resistance value can be reduced. In particular, in the chip resistor of the present invention, the action of dissipating heat to the electrodes can be improved, and the heat can be escaped appropriately toward a heat sink side. In this way, the chip resistor of the present invention has excellent thermal stability and can be mounted on a variety of circuit boards.

This application is based on Japanese Patent Application No. 2018-055880 filed on Mar. 23, 2018, the content of which is hereby incorporated in entirety.

The invention claimed is:

1. A chip resistor, comprising:

a substrate;

a resistive element formed on a surface of the substrate; and electrodes formed on either side of the resistive element, wherein at least a first trimming groove and a second trimming groove are formed in the resistive element, wherein a first edge and a second edge of the resistive element face a direction orthogonal to an inter-electrode direction across the electrodes, wherein the first trimming groove and the second trimming groove include respective first and second vertical grooves that extend, in the direction orthogonal to the inter-electrode direction, from the first edge of the resistive element toward the second edge of the resistive element, and the first trimming groove and the second trimming groove are bent from the vertical grooves to respectively form first and second horizontal grooves extending in the inter-electrode direction, wherein the first vertical groove of the first trimming groove and the second vertical groove of the second trimming groove are formed with a spacing therebetween in the inter-electrode direction, wherein the first horizontal groove of the first trimming groove and the second horizontal groove of the second trimming groove extend in directions approaching each other, and terminal ends of the first horizontal groove and the second horizontal groove are separated with respect to the inter-electrode direction such that the first horizontal groove and the second horizontal groove do not overlap in the orthogonal direction, and wherein the second trimming groove is formed inside a region enclosed between a first virtual line joining the terminal end of the first horizontal groove of the first trimming groove to an intersection point of the electrode on the side that the terminal end of the first horizontal groove faces and the first edge, a second virtual line joining the terminal end of the first horizontal groove to the first edge in the orthogonal direction, and the first edge.

2. The chip resistor according to claim 1, wherein a distance between the first vertical groove of the first trimming groove and the electrode on the side near the first vertical groove is equal to a distance between the second vertical groove of the second trimming groove and the electrode on the side near the second vertical groove.

* * * * *